US005692735A

United States Patent [19]

Aho et al.

[11] Patent Number: 5,692,735

[45] Date of Patent: Dec. 2, 1997

[54] FAIL-SAFE HYDRAULIC VEHICLE WINCH

[75] Inventors: Richard E. Aho, Fort Lauderdale; Martin Baker, Moore Haven, both of Fla.

[73] Assignee: Milemarker, Inc., Pompano Beach, Fla.

[21] Appl. No.: 463,885

[22] Filed: Jun. 5, 1995

[51] Int. Cl.[6] ..... B66D 1/00

[52] U.S. Cl. ..... 254/323; 254/344; 254/361

[58] Field of Search ..... 254/328, 344, 254/361, 323

[56] References Cited

U.S. PATENT DOCUMENTS

| | | | |
|---|---|---|---|
| 2,959,396 | 11/1960 | Lawrence | 254/344 |
| 3,035,414 | 5/1962 | Smith | 60/53 |
| 3,788,605 | 1/1974 | Johnson . | |
| 4,227,680 | 10/1980 | Hrescak | 254/344 |
| 4,650,163 | 3/1987 | Peterson | 254/327 |
| 4,658,850 | 4/1987 | Uchino | 137/101 |
| 4,736,929 | 4/1988 | McMorris | 254/344 |
| 4,746,100 | 5/1988 | Davenport et al. | 254/328 |
| 4,950,125 | 8/1990 | Gravenhorst | 414/569 |
| 5,176,364 | 1/1993 | Bell | 254/291 |
| 5,474,278 | 12/1995 | Cleveland | 254/361 |
| 5,522,582 | 6/1996 | Dilks | 254/344 |

*Primary Examiner*—Katherine Matecki

*Attorney, Agent, or Firm*—Luedeka, Neely & Graham, P.C.

[57] ABSTRACT

A hydraulic winch assembly is attached to a motor vehicle and hydraulically powered by the vehicle's power steering system. A four-way, dual solenoid-operated valve controls the flow of pressurized hydraulic fluid. During normal driving operations while the winch is not in use, hydraulic fluid flows through the valve with no diversion of fluid away from the power steering system. With either of the solenoid coils energized, the valve diverts hydraulic fluid to the winch motor for operation of the winch. Return hydraulic flow from the winch motor maintains sufficiently high pressure to enable the power steering system to function safely during operation of the winch. In this manner, the winch is fail-safe because power steering system operation will not be adversely affected in the event of an inadvertent activation of the winch. Hydraulic fluid is continuously cooled by a cooler, even when the winch is not in operation. The winch is remotely operated by means of a hand-held controller attached to an extended length of electrical cord. By plugging the cord into a recessed connector mounted to the vehicle's bumper, continuity is established between the vehicle battery and valve solenoids when a rocker switch on the controller is manually depressed. Electrical continuity cannot be established unless the controller is plugged into the system. As an added safety feature, continuous depression of the rocker switch is required for winch operation.

22 Claims, 7 Drawing Sheets

FAIL-SAFE HYDRAULIC VEHICLE WINCH

TECHNICAL FIELD

The present invention is directed to a fail-safe, hydraulic vehicle winch which utilizes the vehicle's power steering system as a source of hydraulic power.

BACKGROUND OF THE INVENTION

The advantages of having a winch mounted to a vehicle have long been appreciated. For off-road adventures, a winch provides a highly effective means for extraction of the vehicle when stuck in mud or when the vehicle has become high-centered in rough terrain. The winch extends the range of the vehicle by encouraging the off-road adventurer to push the vehicle's performance envelope where he would otherwise be afraid to do so, and when that envelope has been exceeded, to bring the vehicle back to within its operational limitations. The winch can be used for endless other applications as well, including rescuing other vehicles from perilous mudholes, moving large objects such as felled trees, and towing other vehicles.

Traditionally, the majority of vehicle winches have been powered by electric motors connected to the vehicle battery. These electric winches are large, requiring that they be mounted to the exterior of the vehicle, typically on the front bumper where they are at risk of being easily damaged. The electric switching and reduction gearing required by these winches create inherent reliability and maintainability problems. Additionally, the electric motors used to turn the cable spools require large amounts of electrical power which can quickly deplete the vehicle battery as well as result in overheating of the motor during extended operation.

Hydraulic winches are known to offer several advantages over electric winches. Hydraulic winches are generally more powerful, less complex, smaller, capable of extended operation without undue stress on the motor, and meet high standards for reliability and maintainability. Hydraulic winches have been traditionally designed and adapted for use in specific applications. For example, Gravenhorst, U.S. Pat. No. 4,950,125 discloses the use of a radial piston hydraulic motor in a backhoe-to-crane conversion kit for improved free-fall characteristics; U.S. Pat. No. 5,176,364 to Bell discloses the use of a cable reel winching system having multiple spools and driven by a diesel engine for use on oil and gas wells; and U.S. Pat. No. 4,650,163 to Peterson discloses a hydraulic winch with quick connect features for mounting to the three-point hitch of a tractor.

At least one attempt has been made to incorporate a hydraulic winch onto more non-commercial vehicles. U.S. Pat. No. 3,788,605 to Johnson discloses a hydraulic winch having a hydraulic motor contained within the cable spool for use on an automobile or boat. The hydraulic motor can be operated by hydraulic pressure from the power steering pump of an automobile or by the hydraulic pressure supply system on a boat. Therefore, Johnson purports to teach an accessory winch installed on a vehicle that is powered by a hydraulic system innate to the vehicle. However, Johnson does not account for efficient system operation, reliable system operation, vehicle safety, or human safety.

Johnson does not disclose a means for cooling the hydraulic fluid during operation of the winch. The hydraulic fluid of a vehicle's innate hydraulic system is typically used as a lubricant for a number of moving parts, and resultingly absorbs heat due to the friction of these parts. An out-of-specification condition exists when an accessory hydraulic winch is coupled to the power steering system. Additional stresses are placed on the hydraulic fluid and unless adequate measures are taken to compensate for these increased stresses, such as by increasing fluid volume or increasing fluid cooling, the fluid could overheat and lose its lubricating and cooling properties. If this happened, the power steering and winch components would experience accelerated wear and tear and a reduced life, possibly resulting in catastrophic failures of each.

Vehicle safety is further ignored by Johnson by failing to ensure effective operation of the power steering system in the event of inadvertent winch motor operation. Indeed, Johnson grudgingly admits of this deficiency by stating that winch motor operation should pose no problem to effective power steering system operation because the vehicle is usually standing still while the winch is in operation.

Neither does Johnson account for human safety during operation of the winch. By placing the control lever on the bumper, Johnson exposes the operator to numerous dangers during winch operation. And Johnson's alternate configuration of controlling the lever by a cable from the vehicle's control panel is antiquated, inefficient, and in many applications inoperable.

Another known hydraulic winch system uses a vehicle's hydraulic steering system as a source of hydraulic power and uses a number of valves and associated hydraulic conduit that are installed in the vehicle's existing power steering system. The valves function to direct hydraulic fluid from the power steering system to a hydraulic winch motor which turns a cable spool. One of the valves, a three-port, electrically switchable valve, enables three-state operation of the winch motor and cable spool. In the first state, cable is released from the cable spool in a forward direction. In the second state, cable is retrieved in a reverse direction. In the third state, hydraulic fluid bypasses the winch motor, allowing free spooling of the cable spool. A number of other valves are required to cooperatively operate with the three-state valve in order to achieve these results. These valves also function to isolate the vehicle's hydraulic steering system from the winch system so that only one of these systems function at a time. In other words, when hydraulic fluid is diverted by the valves to the winch system, the hydraulic steering system is inoperable, and vice versa.

SUMMARY OF THE INVENTION

Therefore, it is an object of the present invention to provide a hydraulic winch assembly that can be easily attached to a vehicle's existing power steering and electrical system, enable's effective and safe simultaneous operation of both the power steering system and winch, and one that is fail-safe to both the host vehicle and human operator.

Another object of the present invention is to provide a winch assembly that is capable of sustained, heavy load operation.

Another object of the present invention is to provide a winch assembly that incorporates simplicity and low cost.

Another object of the present invention is to provide a winch assembly that is capable of operating in forward, reverse, free-spooling, and braking modes.

Another object of the present invention is to provide a winch assembly that is remotely operable so as to preclude operation of the winch by any other means, thereby allowing the operator to maintain a safe position during operation of the winch.

Regarding the foregoing and other objects of the invention, the present invention provides a fail-safe, hydraulic winch assembly that utilizes a vehicle's hydraulic steering system as a source of hydraulic pressure. In a preferred embodiment, coupling means are employed to interconnect the drive shaft of a hydraulic motor to a cable spool. A valve having a plurality of valve positions controls hydraulic fluid flow to the motor. The valve has at least one input port connected to the hydraulic steering system for receiving hydraulic fluid and at least one output port connected to the hydraulic motor for sending hydraulic fluid. The hydraulic steering system continuously supplies pressurized hydraulic fluid to the valve, and the valve controls the flow of pressurized hydraulic fluid to the motor. Pressurized hydraulic fluid supplied to the valve is continuously returned to the hydraulic steering system. A cooler is connected to the hydraulic steering system for cooling the hydraulic fluid. Connected to the valve are positioning means for placing the valve in a selected position as determined by a controller, which selectively directs electrical power to the valve positioning means in response to user inputs.

In the preferred embodiment of the invention, a four-port hydraulic valve assembly is disclosed. The valve assembly has first and second electrical coils for controlling, by means of a controller, the flow of pressurized hydraulic fluid between the hydraulic steering system of a vehicle and an accessory hydraulic winch motor attached to the vehicle. Each of the first and second electrical coils have energized and de-energized states. A first valve port is connected to the hydraulic steering system for continuously receiving pressurized hydraulic fluid from the hydraulic steering system. A second valve port is connected to the hydraulic steering system for continuously outputting pressurized hydraulic fluid to the hydraulic steering system. A third valve port is connected to the winch motor for supplying pressurized hydraulic fluid to the winch motor when the first electrical coil is in an energized state, thereby turning the winch motor in a first direction. A fourth valve port is connected to the winch motor for supplying pressurized hydraulic fluid to the winch motor when the second electrical coil is in an energized state, thereby turning the winch motor in a second direction.

In the preferred embodiment of the invention, a hydraulic winch controller is disclosed. The controller controls the operation of a hydraulic winch that is attached to a vehicle having a battery by selective energization of one or more valve solenoids attached to a hydraulic control valve. Interconnecting the controller to the vehicle battery and the valve solenoid is an electrical connector connected to one end of an elongate electrical cord. The other end of the electrical cord is connected to the safety switch of a control unit. The safety switch is moveable through a range of positions and selectively energizes the valve solenoid when it is manually depressed.

In the preferred embodiment, a cable spool assembly is connected to a vehicle winch motor that has a drive shaft. The cable spool assembly is used to release and retrieve cable from a spool and comprises a cable spool with first and second ends and having cable wound around the cable spool between each of the ends. A support is used to support the first end of the cable spool while the second end is supported by a gearbox housing. In this embodiment, the drive shaft extends through the cable spool and connects to the gearbox housing so that the cable spool rotates in response to rotation of the drive shaft. At least one rod connects the support and gearbox housing, thereby supporting the cable spool between the support and gearbox housing.

BRIEF DESCRIPTION OF THE DRAWINGS

The invention will now be described in further detail with reference to the drawings wherein like reference characters designate like or similar elements throughout the several drawing as follows.

DETAILED DESCRIPTION OF THE PREFERRED EMBODIMENT

Figure 1:
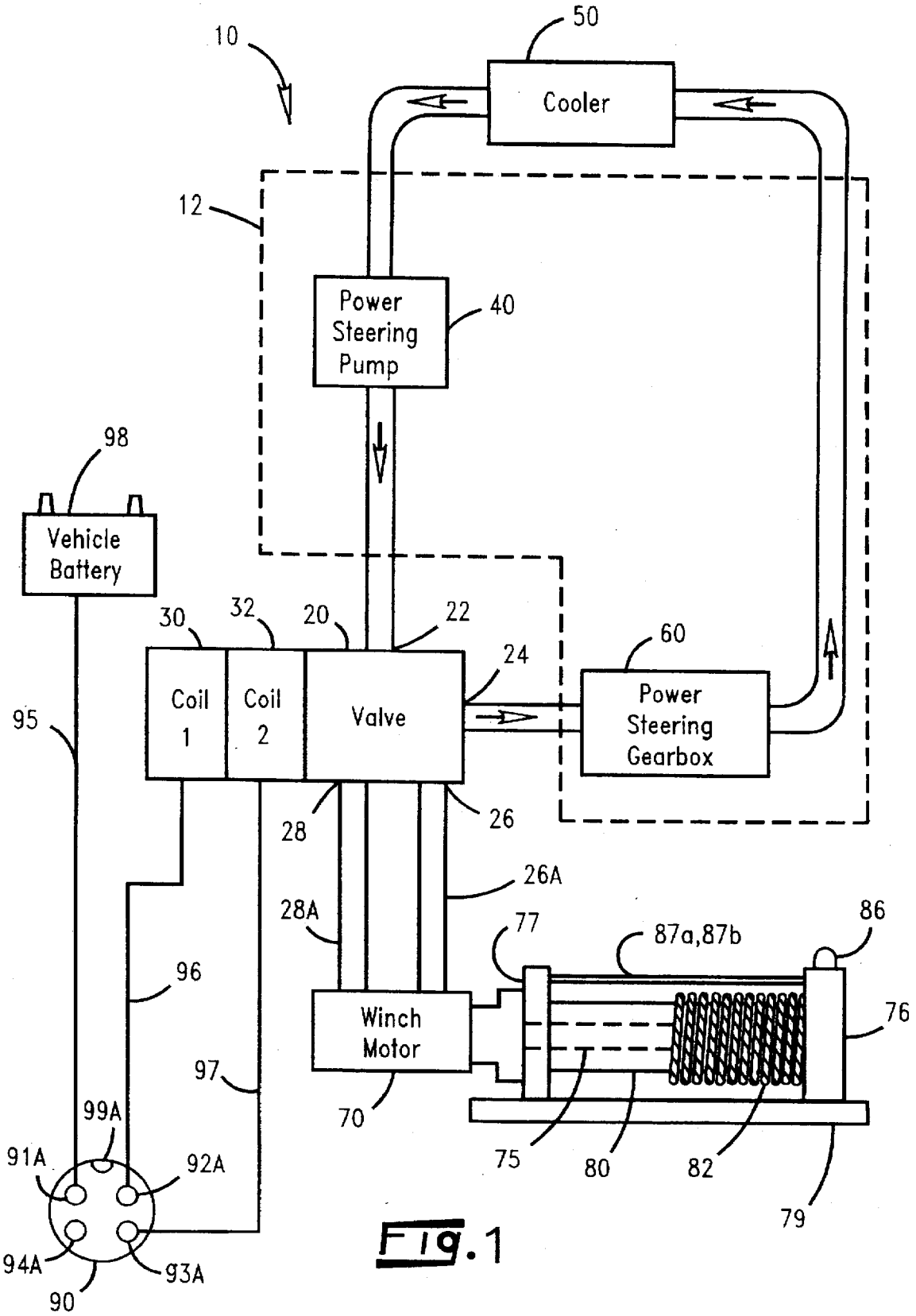
FIG. 1 is a schematic diagram of the hydraulic winch assembly.

In accordance with a preferred embodiment of the present invention as shown in FIG. 1, the hardware configuration for a hydraulic winch assembly 10 is illustrated. The assembly 10 utilizes the existing power steering system 12 of a vehicle, and can be installed on any vehicle that has a power steering system 12 or other comparable hydraulic pressure supply source. Power steering systems vary in design, but most systems typically incorporate at least a power steering pump 40 and a power steering gearbox 60, or some equivalent thereof. A hydraulic valve 20 is connected to the vehicle's power steering system 12 between the power steering pump 40 and the power steering gearbox 60. Typical automobile hydraulic steering pumps have an output capacity of 4 gallons per minute at a pressure of 1500 psi. A winch motor 70 is connected to the valve 20 via high pressure hydraulic conduit 26 and 28. High pressure hydraulic fluid diverted from the power steering system 12 by the valve 70 turns the drive shaft 75 of the winch motor 70 in either a forward or reverse direction.

Figure 5:
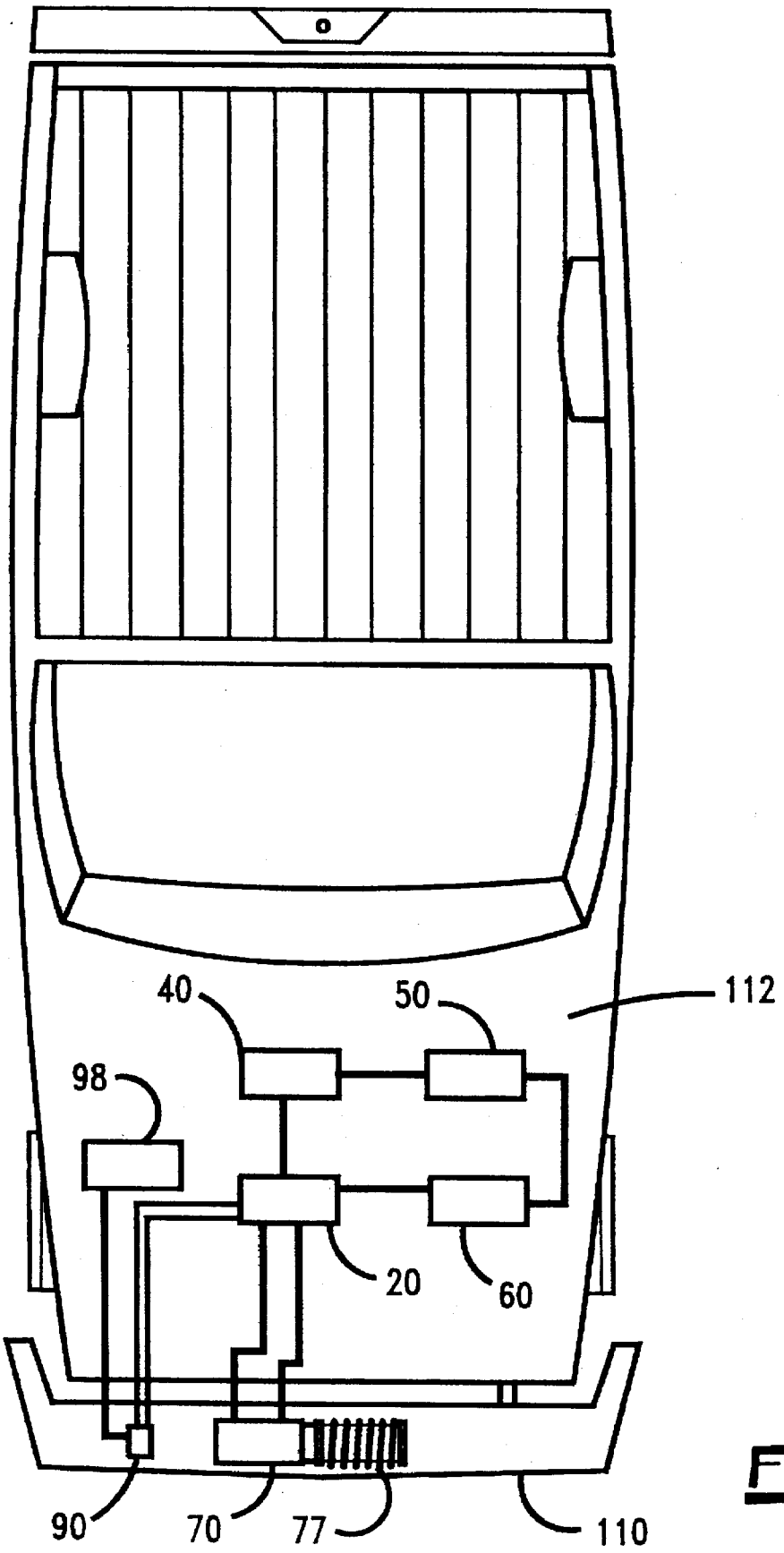
FIG. 5 is a diagram showing general installation features of the hydraulic winch assembly.

The drive shaft 75 extends through the axial center of a cable spool 80 held in place by means of a left support 77 and a gear box housing 76. In the preferred embodiment, the left support 77 is fabricated as part of the winch motor 70. However, it will be appreciated that the left support 77 may be fabricated separate from the winch motor 70. A mounting plate 79 provides a substrate on which the left support 77 and gear box housing 76 rest when attached to the host vehicle. Bolt holes in the mounting plate 79 (shown generally at 52) align with threaded holes in the left support 77 (shown generally at 54), threaded holes in the gear box housing 76 (shown generally at 56), and holes in the host vehicle winch bumper (FIG. 5). The cable spool 80 is coupled to the drive shaft 75 via appropriate reduction gearing contained within the gear box housing 76 so that the spool 80 rotates in response to operation of the winch motor 70, thereby releasing cable 82 from the spool 80 as the winch motor 70 turns in a forward direction and retrieving cable 82 as the winch motor 70 turns in a reverse direction.

Figure 2A:
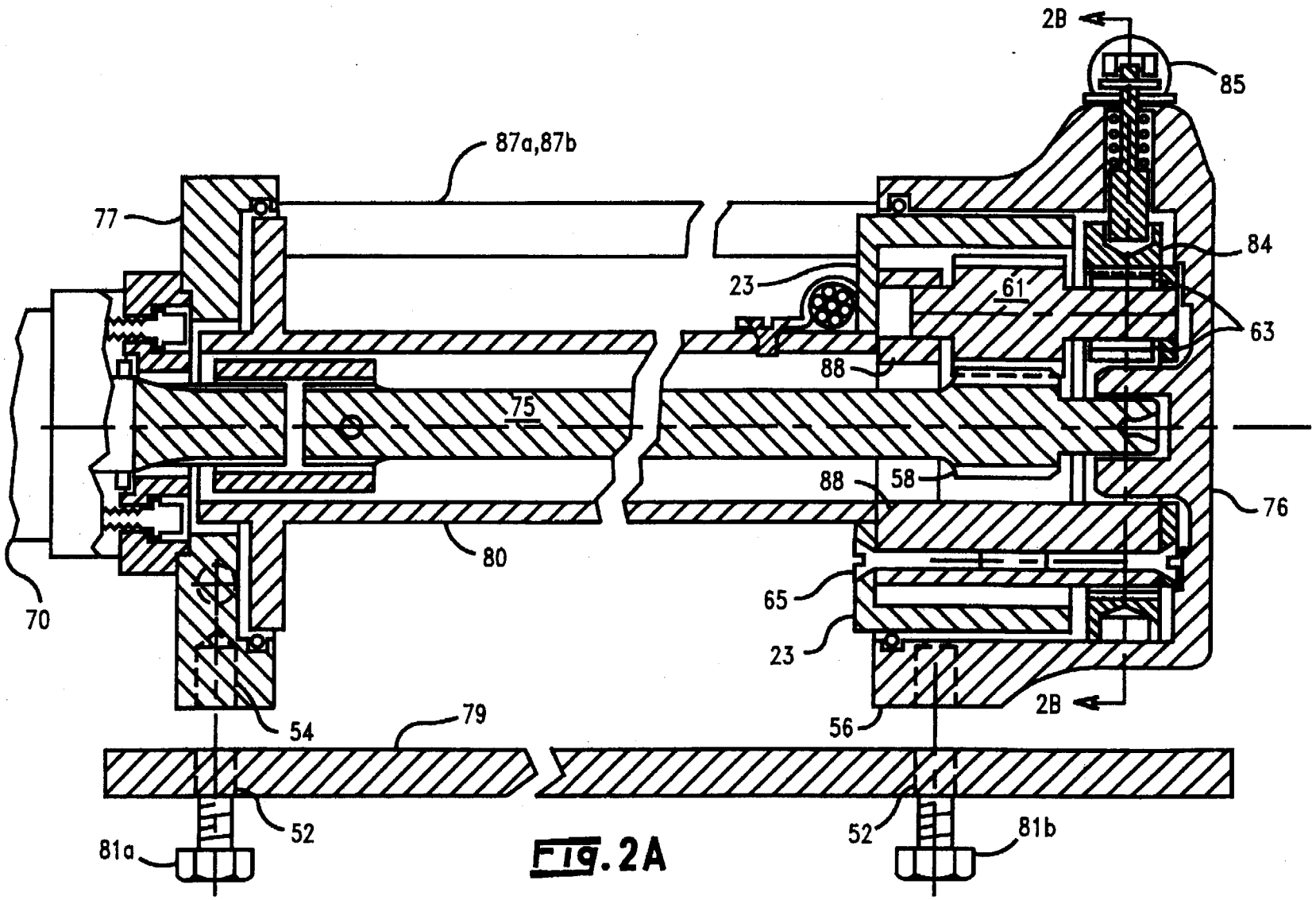
FIG. 2A is a breakaway view of the gear box housing and cable spool assembly.
Figure 2B:
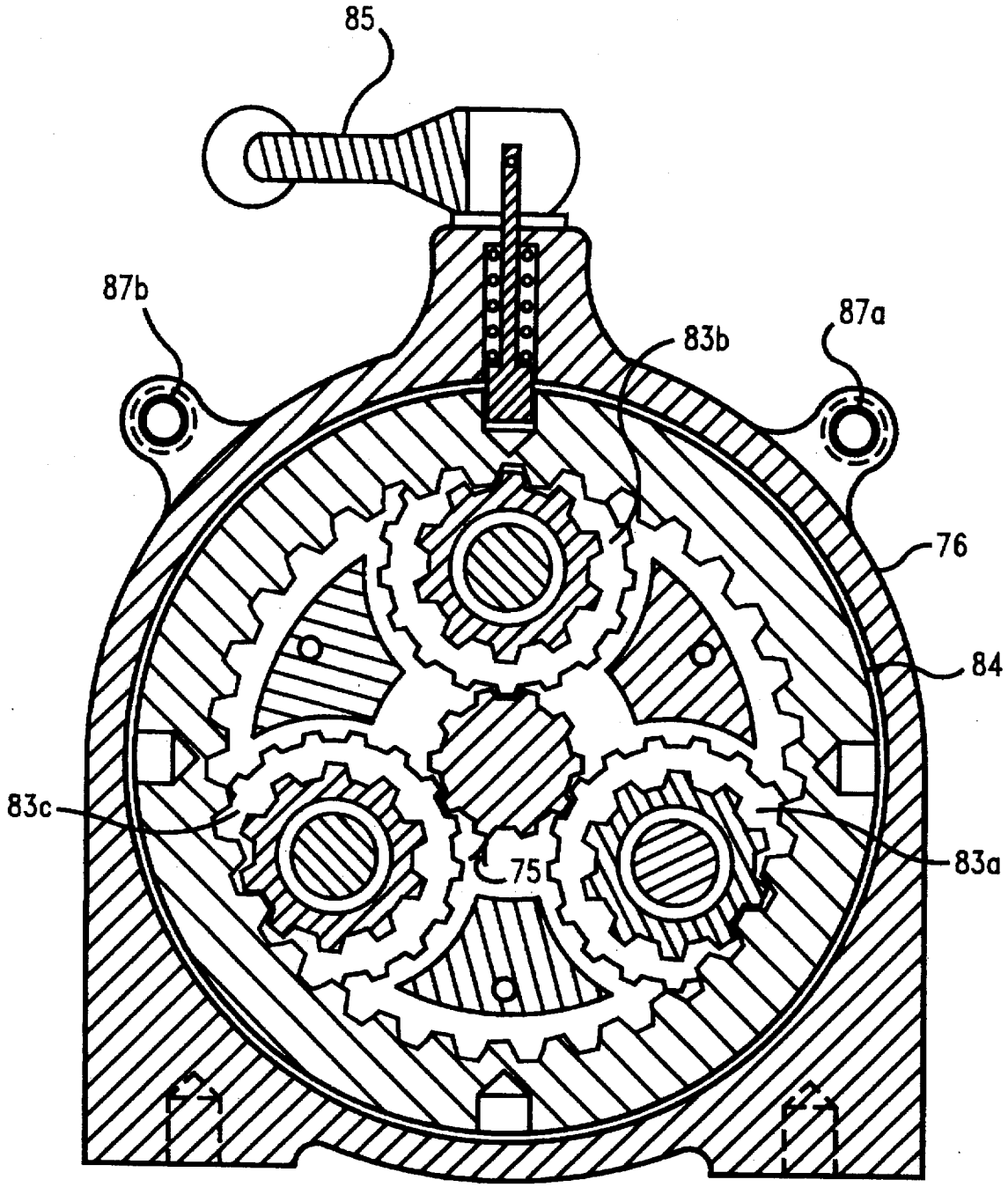
FIG. 2B is a breakaway view of the planetary and ring gear arrangement within the gear box housing.
Figure 2C:
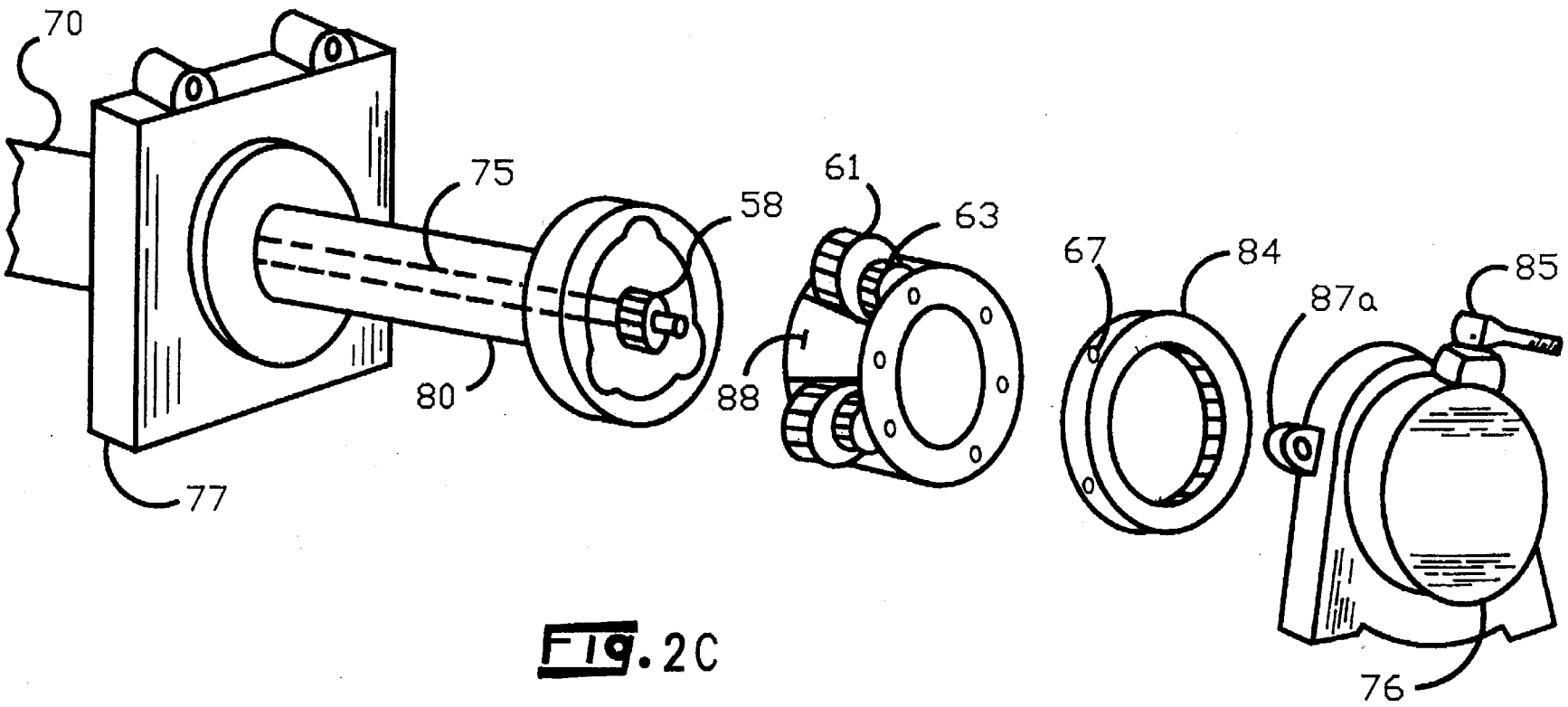
FIG. 2C is an exploded view of the gear box housing and cable spool assembly.

Typical reduction gearing apparatuses and methods can be used to suitably couple the winch motor 70 and cable spool 80, and to provide sufficient torque output to the cable spool 80. However, a preferred reduction gearing apparatus is illustrated in FIGS. 2A–C. As shown in FIGS. 2A–C, the left support 77 and gear box housing 76 are mounted to the base plate 79 and host vehicle by means of bolts shown generally as 81*a* and 81*b*. The left support 77 and gear box housing 76 are connected near their tops by means of two rods shown generally at 87*a* and 87*b*. Although two rods 87*a*, and 87*b* are provided in the preferred embodiment, it will be understood that a single rod can be used instead. Further, it will be appreciated that when the rods 87*a* and 87*b* are removed, the left support 77, the gearbox housing 76, and the cable spool 80 are no longer connected and can be pulled apart freely, thereby simplifying maintenance. In other words, the cable spool 80 is effectively held in place and supported by the left support 77 and the gearbox housing 76 when the latter are connected by means of rods 87*a* and 87*b*.

The winch motor drive shaft 75 extends through the axial center of the cable spool 80 and engages an arrangement of three compound planet gears 83*a–c* housed in a cage 88 that is rigidly connected to the cable spool 80 by means of three screws 65, each compound planet gear 83*a–c* having a large planet 61 and a small planet 63. A spindle 58 on the end of the drive shaft 75 engages the large planet 61 so that both large and small planets 61 and 63 turn in response to rotation of the spindle 58. A ring gear 84 meshes with the small planets 63 so that when the ring gear 84 is locked to the gear box housing by means of a moveable lock pin 85, rotation of the drive shaft 75 produces gear reduced rotation of the cable spool 80. This gear reduction arrangement produces a maximum torque of 9,000 ft lbs on the cable spool 80 and a nominal spool rotation rate of 10 rpm during winch motor operation.

The lock pin 85 mechanically couples the ring gear 84 to the gear box housing 76 by means of detents 67 along the outer surface of the ring gear 84 so that when the pin 85 is retracted and thereby removed from the detents 67, the ring gear 84 and planet gears 83*a–c* are drivingly decoupled from the cable spool 80. In other words, retracting the pin 85 from the ring gear 84 effectively decouples the winch motor drive shaft 75 from the cable spool 80 and the cable spool 80 free spools. In this manner, a free spooling capability is disclosed whereby cable 82 may be wound and unwound from the cable spool 80 without the assistance of the winch motor 70. This free spooling capability is particularly useful for rapid removal of cable 82 from the cable spool 80.

Figure 3A:
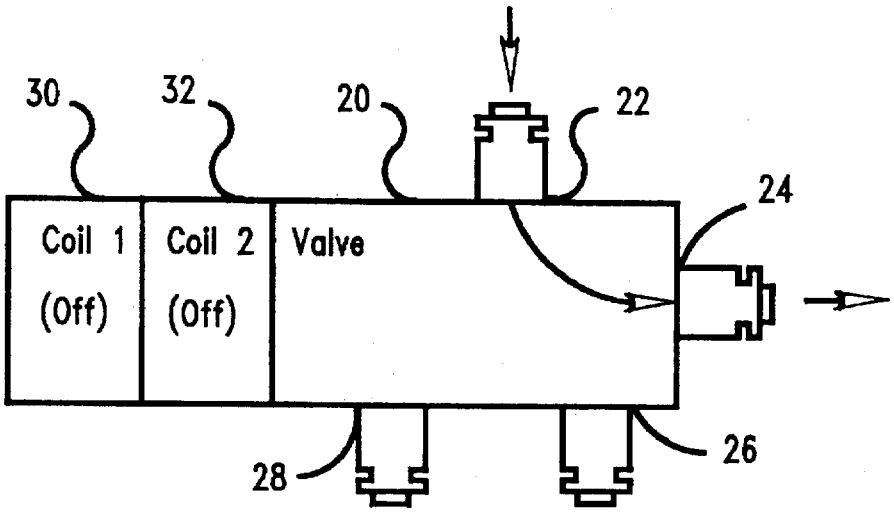
FIG. 3A is functional diagram of the valve while coils 1 and 2 are de-energized.

In a preferred embodiment, the valve 20 is a HYDRAFORCE® SV10-47A four-way, three-position, tandem center, solenoid-operated valve and enables simultaneous operation of the winch motor 70 and power steering gearbox 60. The valve 20 is operated by means of two electrical coils 30 and 32, each having an energized and a de-energized state. When both coils 30 and 32 are in a de-energized state, hydraulic fluid flows directly from the power steering pump 40 to the power steering gearbox 60 with no hydraulic fluid flow to the winch motor 70. FIG. 3A functionally illustrates the flow of hydraulic fluid through the valve 20 when both coils 30 and 32 are de-energized. Fluid flows from the power steering pump 40 and enters the valve 20 through port 22. The fluid then directly exits the valve 20 through port 24 where it flows to the power steering gearbox 60. When both coils 30 and 32 are de-energized, no fluid flows through ports 26 and 28, so that the valve 20 functions the same as a simple connector, connecting the power steering pump 40 to the power steering gearbox 60.

Figure 3B:
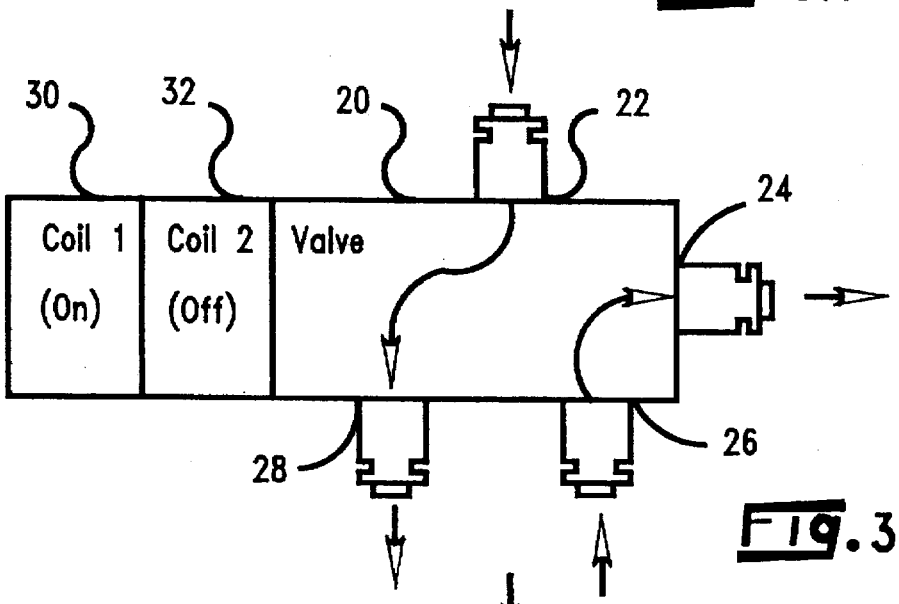
FIG. 3B is a functional diagram of the valve while coil 1 is de-energized and coil 2 is energized.

For an appropriately wound cable spool 80, cable 82 is released from the cable spool 80 by energizing coil 30. FIG. 3B illustrates the flow of hydraulic fluid through the valve 20 when coil 30 is energized. With coil 30 energized, high pressure hydraulic fluid from the pump 40 enters the valve 20 through port 22 and exits the valve 20 through port 28 where it flows to the winch motor 70. High pressure hydraulic fluid flowing through this path acts on the winch motor 70 to turn it in a forward direction, thereby releasing cable 82 as the cable spool 80 rotates. Hydraulic fluid returns from the winch motor 70 and re-enters the valve 20 through port 26. Fluid returning through port 26 exits the valve 20 through port 24 where it flows to the gearbox 60. This return flow from the winch motor 70 maintains sufficiently high pressure to enable operation of both the winch motor 70 and the gearbox 60 when coil 30 is energized. In this manner, the system 10 functions as a fail-safe hydraulic winch because even if coil 30 were to fail in an energized state, the failure would not affect vehicle safety or performance. In other words, the vehicle's power steering system 12 would continue to function safely even if coil 30 were inadvertently energized to continuously supply hydraulic pressure to the winch motor 70. As a further measure of fail-safe protection, a spring (not shown) within the valve returns the valve ports 22–28 to their de-energized positions in the event of electrical power loss to the coils 30 and 32.

Figure 3C:
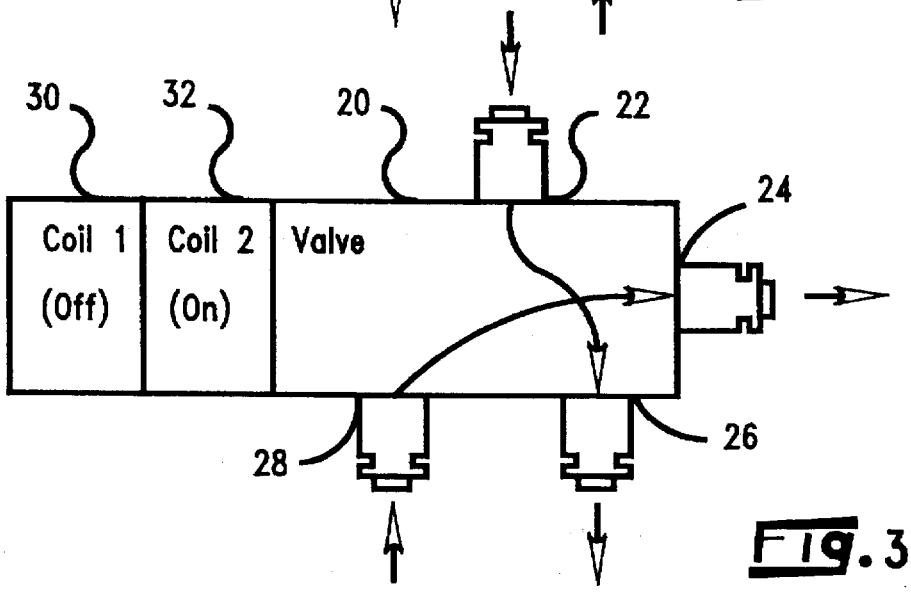
FIG. 3C is a functional diagram of the valve while coil 1 is de-energized and coil 2 is energized.

Cable 82 is retrieved onto the cable spool 80 by energizing coil 32. FIG. 3C illustrates the flow of hydraulic fluid through the valve 20 when coil 32 is energized. With coil 32 energized, hydraulic fluid follows a different path through the valve 20. This path consists of high pressure hydraulic fluid flowing from the power steering pump 40, entering the valve 20 through port 22, and exiting the valve 20 through port 26. After exiting through port 26, the fluid acts upon the winch motor 70 to turn it in a forward direction so that cable 82 on the cable spool 80 is reeled in. Hydraulic fluid returns from the winch motor 70 and re-enters the valve 20 through port 28 where it then exits the valve 20 at port 24 with sufficient pressure to act upon the power steering gearbox 60. Therefore, the flow of hydraulic fluid from valve 20 to winch motor 70 and then back to valve 20 is exactly reversed from the direction of flow created when coil 30 is energized.

Referring again to FIG. 1, low pressure hydraulic fluid exiting the gearbox 60 enters a cooler 50 where the hydraulic fluid is cooled. The cooled hydraulic fluid then exits the cooler 50 and enters the power steering pump 40 for repressurization. The cooler 50 is not innate to the vehicle's power steering system 12 and is generally required only during operation of the winch motor 70 as an added measure of protection to the power steering system 12 and winch motor 70. However, once installed, the cooler 50 functions continuously to cool the hydraulic fluid while the vehicle's engine is operating, thereby providing an extra level of protection for the power steering system 12.

Electrical power to energize coils 30 and 32 is provided by the vehicle's battery 98. An electrical connection 95 extends from the battery 98 to a recessed male connector 90 where it is connected to pin 91A. As shown in FIG. 5, the male connector 90 is mounted to a standard winch bumper 110 to allow easy access from outside the vehicle 200. The connector 90 may be either male or female; however, a male connector is preferred in this use because male connectors are generally more tolerant of exposure to dirt, water, and other nature elements. As a further measure of protection, the pins 91A, 91B, and 91C are preferably recessed from the edge of the bumper 110 and protected from the elements by a standard flip cover (not shown) attached to the bumper 110. Alternatively, connector 90 may be mounted at any easily accessible point on the vehicle 200, including the vehicle's interior. Line 96 electrically connects coil 30 to pin 92A of connector 90. Likewise, line 97 electrically connects coil 32 to pin 93A of male connector 90. Pin 94A is unused.

Referring again to the installation of FIG. 5, a preferred method of mounting the winch motor 70 and cable spool 80 is illustrated. Just as the system 10 (FIG. 1) utilizes the host vehicle's existing hydraulic system 12 and battery 98 to enhance efficiency and useability while reducing parts and costs, installation of the winch motor 70 and cable spool 80 is likewise enhanced by utilizing standard mounting equipment when possible. A standard winch bumper 110 provides a level platform for mounting these components, but it will be appreciated that the winch motor 70 and cable spool 80 may instead be mounted in the vehicle's engine compartment 112 with appropriate mounting provisions. Standard four-hole bolt patterns (not shown) for mounting existing electrical winches are exploited to mount the motor 70 and cable spool 80 to the bumper 110.

Figure 4:
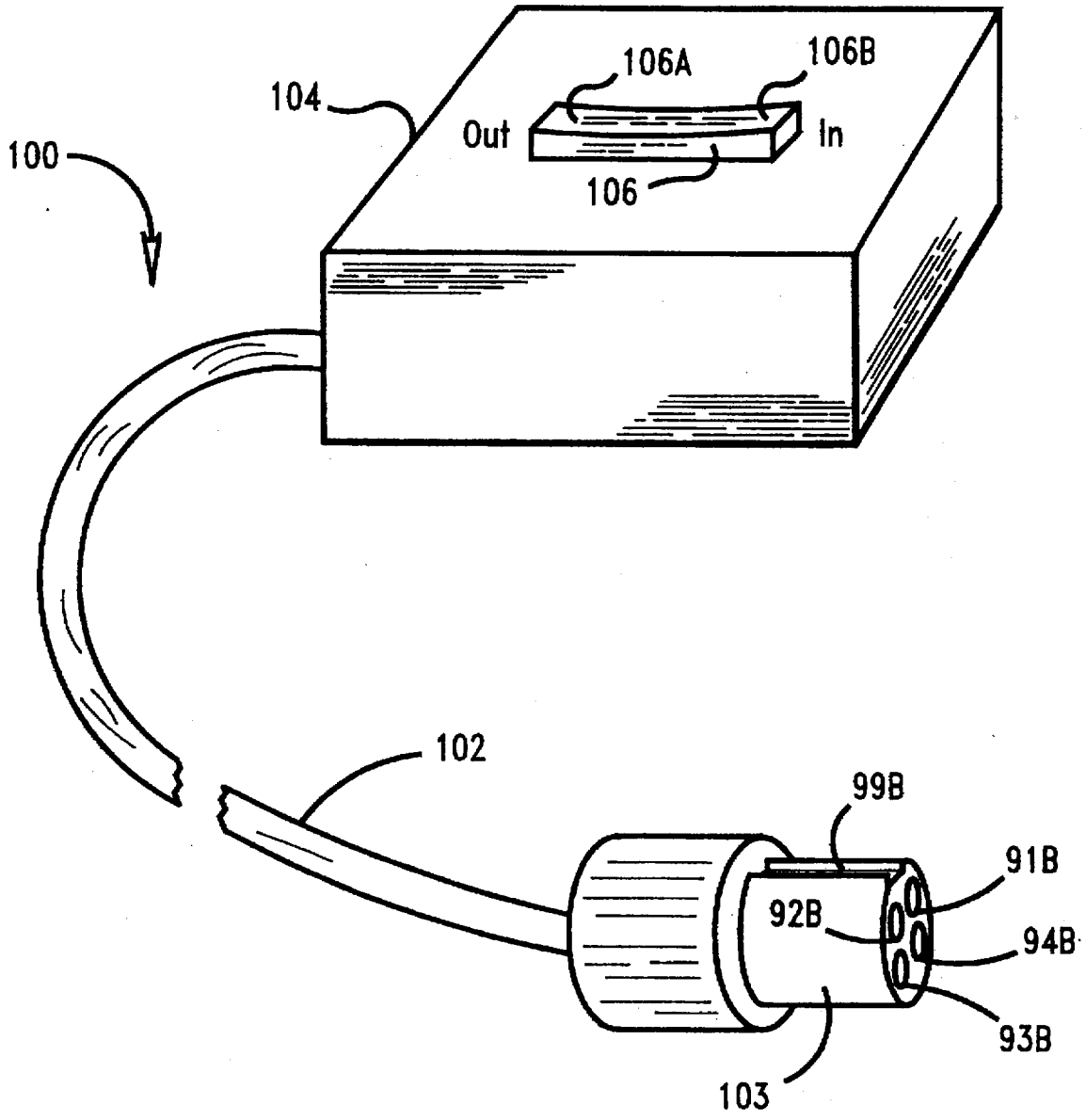
FIG. 4 is a diagram of the remote controller.

Electrical continuity between the battery 98 and the coils 30 and 32 is selectively established via the remote switch assembly 100 shown in FIG. 4. In an alternate embodiment, winch controls may be hard-mounted to the interior of the vehicle. Additionally, it will be appreciated that the winch assembly may be operated by wireless remote control. The remote switch 100 is attached to the recessed male connector 90 at the vehicle's bumper by means of a female connector 103. The female connector is preferably keyed **99*a* and 99*b* to ensure proper alignment of the pins 91A, 92A, 93A, and 94A with the receptacles 91B, 92B, 93B, and 94B. When properly aligned, pin 91A is inserted into receptacle 91B, pin 92A is inserted into receptacle 92B, pin 93A is inserted into receptacle 93B, and pin 94A is inserted into receptacle 94B. A controller 104 with a rocker switch 106 is connected to the female connector 103 via an extended length of electrical cord 102 so that as the rocker switch 106 is depressed to the "OUT" position 106A, continuity is established between the vehicle battery 98 and coil 30, thereby releasing cable 82 from the cable spool 80. When the rocker switch 106 is depressed to the "IN" position 106B, continuity is established between the vehicle battery 98 and coil 32, thereby retrieving cable 82 onto the cable spool 80**.

In operation, the winch operator is typically positioned outside the vehicle to provide the operator with an unobstructed view. The extended cord 102 enables the operator to maintain a safe distance while operating the winch. It will be understood that the winch can also be operated with the winch operator positioned inside the vehicle. With the vehicle's engine operating to provide power to the power steering system 12, the operator simply depresses the rocker switch 106 to the desired position and maintains pressure on the rocker switch 106 for the desired length of time. Cable 82 is unwound by depressing the rocker switch 106 to the "OUT" position 106A, and cable 82 is retrieved by depressing the rocker switch 106 to the "IN" position 106B. A safety feature of the remote switch 100 is that once the operator releases the rocker switch 106, continuity is broken between the vehicle battery 98 and the coils 30 and 32, thereby ceasing operation of the winch motor 70. Connecting the controller 104 to the vehicle by means of an extended length of cord 102, such as ten feet, enables the operator to maintain a safe distance during winch motor 70 operation.

A significant safety advantage of this remote switching approach is that it virtually eliminates the possibility of having electrical power inadvertently applied to the coils 30 and 32. Even if power is inadvertently applied, the system is fail-safe because the functioning of the power steering system 12 will not be adversely affected.

It will be understood that other types of valves having the capability of enabling simultaneous operation of the power steering gearbox 60 and winch motor 70 may be used in place of the SV10-47A. For example, it is contemplated that a valve having a single solenoid may be used; the single solenoid being capable of variably positioning the valve in response to variable levels of electrical excitation.

It is contemplated, and will be apparent to those skilled in the art from the preceding description and accompanying drawings that modifications and/or changes may be made in the embodiments of the invention. Accordingly, it is expressly intended that the foregoing description and accompanying drawings are illustrative of preferred embodiments only, not limiting thereto, and that the true spirit and scope of the present invention be determined by reference to the appended claims.

What is claimed is:

1. A hydraulic winch assembly that derives hydraulic power from pressurized hydraulic fluid produced by the hydraulic steering system of a vehicle with a battery, comprising:

a hydraulic motor with a drive shaft;

a cable spool connected to the drive shaft of the hydraulic motor;

coupling means for interconnecting the cable spool and drive shaft;

a valve having a plurality of valve positions, said valve having at least one input port connected to the hydraulic steering system for receiving hydraulic fluid and at least one output port connected to the hydraulic steering system for sending hydraulic fluid, said hydraulic steering system continuously supplying pressurized hydraulic fluid to said valve, said valve controlling the flow of pressurized hydraulic fluid to said motor and continuously returning pressurized hydraulic fluid to said hydraulic steering system;

a cooler connected to the hydraulic steering system for cooling the hydraulic fluid;

positioning means connected to said valve for placing the valve in a selected position; and a controller for selectively directing electrical power to the positioning means by an operator.

2. The hydraulic winch assembly as described in claim 1, wherein said coupling means comprises gear reduction means.

3. The hydraulic winch assembly as described in claim 1, wherein said coupling means comprises:

a ring gear;

a plurality of compound planet gears, each planet gear having a large planet and a small planet, said large planet driven by the drive shaft, said small planet meshing with the ring gear, said planet gears arranged in a cage that is connected to said cable spool; and a housing for containing said planet and ring gears and locking said ring gear so that said cable spool rotates in response to rotation of the drive shaft.

4. The hydraulic winch assembly as described in claim 3, wherein said housing further comprises a moveable lock pin having an extended position and a retracted position so that the ring gear is locked when the pin is in said extended position and the ring gear is unlocked when the pin is in said retracted position, wherein the cable spool free spools when the ring gear is unlocked.

5. The hydraulic winch assembly as described in claim 1, wherein said controller is further operable to selectively direct electrical power from said battery to the positioning means by an operator.

6. The hydraulic winch assembly as described in claim 1, wherein said positioning means comprise:

a first electrical coil having energized and de-energized states and connected to the valve for producing a first valve position when said first electrical coil is in an energized state; and a second electrical coil having energized and de-energized states and connected to the valve for producing a second valve position when said second electrical coil is in an energized state.

7. The hydraulic winch assembly as described in claim 6, wherein said controller further comprises:

a power input for receiving electrical power from the vehicle battery;

a first power output for providing electrical excitation to said first electrical coil, placing said first electrical coil in an energized state so that the winch motor turns in a first direction;

a second power output for providing electrical excitation to said second electrical coil, placing said second electrical coil in an energized state so that the winch motor turns in a second direction; and a switch for selectively routing electrical power received by the power input to the power outputs.

8. The hydraulic winch assembly as described in claim 7, wherein said switch requires continuous depression by the operator to maintain electrical excitation to said first and second power outputs.

9. The hydraulic winch assembly as described in claim 6, wherein said valve is a four-port hydraulic valve comprising:

a first port connected to the hydraulic steering system for continuously receiving pressurized hydraulic fluid from the hydraulic steering system;

a second port connected to the hydraulic steering system for continuously outputting pressurized hydraulic fluid to the hydraulic steering system;

a third port connected to the winch motor for supplying pressurized hydraulic fluid to the winch motor when said first electrical coil is in an energized state; and a fourth port connected to the winch motor for supplying pressurized hydraulic fluid to the winch motor when said second electrical coil is in an energized state.

10. The hydraulic winch assembly as described in claim 9, wherein said third and fourth ports function to alternately receive return hydraulic fluid from the winch motor and route it to said second port for output to the hydraulic steering system.

11. The hydraulic winch assembly as described in claim 1, wherein said controller is detachably connectable to the vehicle battery and said first and second electrical coils.

12. A four-port hydraulic valve assembly having first and second electrical coils for controlling, by means of a controller, the flow of pressurized hydraulic fluid between the hydraulic steering system of a vehicle and an accessory hydraulic winch motor attached to the vehicle, said first and second electrical coils having energized and de-energized states, said valve comprising:

a first port connected to the hydraulic steering system for continuously receiving pressurized hydraulic fluid from the hydraulic steering system;

a second port connected to the hydraulic steering system for continuously outputting pressurized hydraulic fluid to the hydraulic steering system;

a third port connected to the winch motor for supplying pressurized hydraulic fluid to the winch motor when said first electrical coil is in an energized state so that the winch motor turns in a first direction; and a fourth port connected to the winch motor for supplying pressurized hydraulic fluid to the winch motor when said second electrical coil is in an energized state so that the winch motor turns in a second direction.

13. The hydraulic valve assembly as described in claim 12, wherein said third and fourth ports function to alternately receive return hydraulic fluid from the winch motor and route the fluid to said second port for output to the hydraulic steering system.

14. The hydraulic valve assembly as described in claim 12, wherein said first and second electrical coils are selectively energized by the controller.

15. A hydraulic winch controller for remotely controlling the operation of a hydraulic winch attached to a vehicle having a battery by selective energization of one or more valve solenoids attached to a hydraulic control valve, said controller comprising:

an electrical connector for interconnecting the controller to the vehicle battery and the valve solenoid;

an elongate electrical cord having a first end and a second end, said first end connected to the electrical connector; and a control unit having a safety switch moveable through a range of positions, said safety switch connected to the second end of said electrical cord for selective energization of the valve solenoid when said safety switch is manually depressed.

16. The hydraulic winch controller as described in claim 15, wherein said safety switch requires continuous depression to maintain continuous energization of said valve solenoid.

17. The hydraulic winch controller as described in claim 15, wherein the range of positions of said safety switch comprise at least a first position for operating the winch in a first direction, and a second position for operating the winch in a second direction.

18. The hydraulic winch controller as described in claim 15, wherein said electrical connector further comprises a keyed female connector.

19. A cable spool assembly connected to a vehicle winch motor with a drive shaft for releasing and retrieving cable from a spool, comprising:

a cable spool with cable, said cable spool having a first end and a second end;

a support for supporting the first end of the cable spool;

a gearbox housing for supporting the second end of the cable spool;

wherein said drive shaft extends through the cable spool and connects to the gearbox housing so that the cable spool rotates in response to rotation of the drive shaft; and at least one rod for connecting the support and gearbox housing, whereby the cable spool is supported between the support and gearbox housing.

20. The cable spool assembly as described in claim 19, wherein said gearbox housing further comprises:

a ring gear locked to the gearbox housing; and a plurality of compound planet gears, each planet gear having a large planet and a small planet, said large planet driven by the drive shaft, said small planet meshing with the ring gear, said planet gears arranged in a cage that is connected to said cable spool;

wherein said cable spool rotates in response to rotation of the drive shaft.

21. The cable spool assembly as described in claim 20, further comprising means for selectably unlocking the ring gear from said gearbox housing so that the cable spool free spools when the ring gear is unlocked.

22. A hydraulic winch assembly which derives hydraulic power from a hydraulic power supply system of a vehicle with a battery, said winch assembly comprising:

a hydraulic motor with a drive shaft;

a cable spool connected to the drive shaft of the hydraulic motor;

coupling means for interconnecting the cable spool and drive shaft;

a valve having a plurality of valve positions, said valve having an input port connected to the hydraulic power supply system for continuously receiving hydraulic fluid and an output port connected to the hydraulic power supply system for continuously sending hydraulic fluid back to the hydraulic power supply system, said valve controlling the flow of pressurized hydraulic fluid to said motor;

positioning means connected to said valve for placing the valve in a selected position; and a controller for selectively directing electrical power to the positioning means by an operator.

* * * * *